US009416681B2

(12) United States Patent
Oda et al.

(10) Patent No.: US 9,416,681 B2
(45) Date of Patent: Aug. 16, 2016

(54) TURBO COMPRESSOR

(71) Applicant: DAIKIN INDUSTRIES, LTD., Osaka-Shi (JP)

(72) Inventors: Kentarou Oda, Tokyo (JP); Nobuyoshi Sakuma, Tokyo (JP)

(73) Assignee: DAIKIN INDUSTRIES, LTD., Osaka-shi (JP)

( * ) Notice: Subject to any disclaimer, the term of this patent is extended or adjusted under 35 U.S.C. 154(b) by 328 days.

(21) Appl. No.: 14/141,510

(22) Filed: Dec. 27, 2013

(65) Prior Publication Data

US 2014/0102831 A1 Apr. 17, 2014

Related U.S. Application Data

(63) Continuation of application No. PCT/JP2012/067339, filed on Jul. 6, 2012.

(30) Foreign Application Priority Data

Jul. 13, 2011 (JP) ..... 2011-154647

(51) Int. Cl.
*F01D 25/18* (2006.01)
*F04D 25/16* (2006.01)
(Continued)

(52) U.S. Cl.
CPC ..... *F01D 25/18* (2013.01); *F04D 17/12* (2013.01); *F04D 25/02* (2013.01); *F04D 25/163* (2013.01); *F04D 29/063* (2013.01)

(58) Field of Classification Search
CPC ..... F01D 25/18; F04D 17/12; F04D 25/02; F04D 25/163; F04D 29/063
USPC ..... 184/13.1, 6.12, 6.16, 6.26
See application file for complete search history.

(56) References Cited

U.S. PATENT DOCUMENTS 4,010,016 A * 3/1977 Haugen ..... 55/473
5,301,771 A 4/1994 Sishtla et al.
(Continued)

FOREIGN PATENT DOCUMENTS

CN 101963162 A 2/2011
JP 51-105607 A 9/1976
(Continued)

OTHER PUBLICATIONS

International Search Report mailed Oct. 2, 2012 for PCT/JP2012/067339 filed on Jul. 6, 2012 with English Translation.
(Continued)

*Primary Examiner* — William E Dondero
*Assistant Examiner* — Robert T Reese
(74) *Attorney, Agent, or Firm* — Oblon, McClelland, Maier & Neustadt, L.L.P.

(57) ABSTRACT

A turbo compressor includes a housing in which lubrication oil is accumulated, a gear that is housed in the housing and to which the lubrication oil is supplied, a demister that is disposed above the gear and on which an intake is provided to catch oil mist of the lubrication oil in the housing, a gear cover that is provided surrounding the gear to catch lubrication oil splashed by the gear and then drip the caught lubrication oil downward, and a demister cover that is disposed near the demister to drip the lubrication oil caught by the demister downward. Here, a narrow gap is formed between the demister cover and an inner wall surface of the housing. According to the turbo compressor, an amount of lubrication oil flowing through the demister can be reduced by the gear cover and the demister cover.

5 Claims, 4 Drawing Sheets

(51) Int. Cl.

| | |
|---|---|
| ***F04D 29/063*** | (2006.01) |
| ***F04D 17/12*** | (2006.01) |
| ***F04D 25/02*** | (2006.01) |

(56) References Cited

U.S. PATENT DOCUMENTS

| | | | | |
|---|---|---|---|---|
| 5,404,964 | A | 4/1995 | Zinsmeyer et al. | |
| 5,685,699 | A | 11/1997 | Holmes et al. | |
| 6,018,962 | A | 2/2000 | Dewhirst et al. | |
| 2006/0196220 | A1 | 9/2006 | Westermeyer | |
| 2011/0016914 | A1* | 1/2011 | Oda et al. | 62/468 |
| 2014/0159369 | A1* | 6/2014 | Tsuboi et al. | 290/52 |

FOREIGN PATENT DOCUMENTS

| | | | |
|---|---|---|---|
| JP | 05-223092 | A | 8/1993 |
| JP | 2011-026960 | A | 2/2011 |

OTHER PUBLICATIONS

International Written Opinion mailed Oct. 2, 2012 for PCT/JP2012/067339 filed on Jul. 6, 2012.

Extended European Search Report issued Dec. 22, 2014 in Patent Application No. 12811147.3.

Combined Office Action and Search Report issued Jun. 24, 2015 in Chinese Patent Application No. 201280034158.X (with English translation of Category Documents).

* cited by examiner

TURBO COMPRESSOR

CROSS-REFERENCE TO RELATED APPLICATIONS

The present application is a Continuation Application of PCT International Application No. PCT/JP2012/067339 (filed on Jul. 6, 2012), which is based upon and claims the benefit of priority from Japanese Patent Application No. 2011-154647 (filed on Jul. 13, 2011), the entire contents of which are incorporated herein with reference.

BACKGROUND OF THE INVENTION

1. Technical Field

The present invention relates to a turbo compressor capable of compressing fluid by its plural impeller.

2. Background Art

As a conventional turbo compressor to be applied to a turbo refrigerator or the like, one disclosed in a Patent Document 1 (Japanese Patent Application Laid-Open No. 2011-26960) is known. The turbo compressor includes a housing in which lubrication oil is accumulated, a large-diameter gear housed in the housing, and a demister disposed above the large-diameter gear in the housing. The large-diameter gear supplies the lubrication oil by its rotations. The demister is provided with intakes communicating with an outside of the housing. The demister catches oil mist of the lubrication oil splashed by rotations of the large-diameter gear to return it to a lower portion of the housing.

In the turbo compressor, the intakes of the demister are connected with a lower-pressure space than an inside of the housing via a pressure equalizing pipe, and thereby pressure rise in the housing is restricted. In addition, the oil mist of the lubrication oil is generated in the housing by the rotations of the large-diameter gear. Therefore, the demister catches the oil mist when inside air in the housing is inhaled from the intakes and returns it to the lower portion of the housing in order to prevent the lubrication oil from being discharged out from the housing.

SUMMARY OF INVENTION

However, in the above turbo compressor, there is a possibility that the demister cannot catch the lubrication oil completely if the lubrication oil passing through the demister is too much, and thereby the lubrication oil may be discharged out from the housing.

An object of the present invention is to provide a turbo compressor that can reduce an amount of lubrication oil passing through a demister.

An aspect of the present invention provides a turbo compressor comprising: a housing in which lubrication oil is accumulated; a gear that is housed in the housing and to which the lubrication oil is supplied; a demister that is disposed above the gear and on which an intake is provided to catch oil mist of the lubrication oil in the housing; a gear cover that is provided surrounding the gear to catch lubrication oil splashed by the gear and then drip the caught lubrication oil downward; and a demister cover that is disposed near the demister to drip the lubrication oil caught by the demister downward, wherein a narrow gap is formed between the demister cover and an inner wall surface of the housing.

Since the gear cover that drips the lubrication oil splashed by the gear downward is provided so as to surround the gear in the turbo compressor, a distance between the lubrication oil accumulated at a lower portion of the housing and the demister can be made long and thereby the lubrication oil is restricted from reaching the demister.

In addition, since the demister cover for dripping the lubrication oil caught by the demister downward is provided near the demister, lubrication oil that is not caught by the gear cover can be restricted from reaching the intake by the demister cover.

Therefore, according to the turbo compressor, an amount of lubrication oil that reaches the demister can be reduced by the gear cover and the demister cover.

Here, it is preferable that a lower end edge of the gear cover counter to a rotational direction of the gear is extended downward further than an opposed-side lower end edge. According to this, spatters of the lubrication oil can be restricted effectively on a predominant side of the lubrication oil splashed by the gear. In addition, the gear cover can be light-weighted because the opposed-side lower end edge is made minimum.

In addition, it is preferable that a total area of the narrow gap is made larger than an opening area of the intake of the demister. According to this, an amount of lubrication oil that reaches the demister can be reduced by the demister cover without degrading inhale performance of the demister.

DESCRIPTION OF EMBODIMENT

First, a turbo refrigerator 101 to which a turbo compressor 1 according to an embodiment is applied will be explained with reference to FIG. 1.

Figure 1:
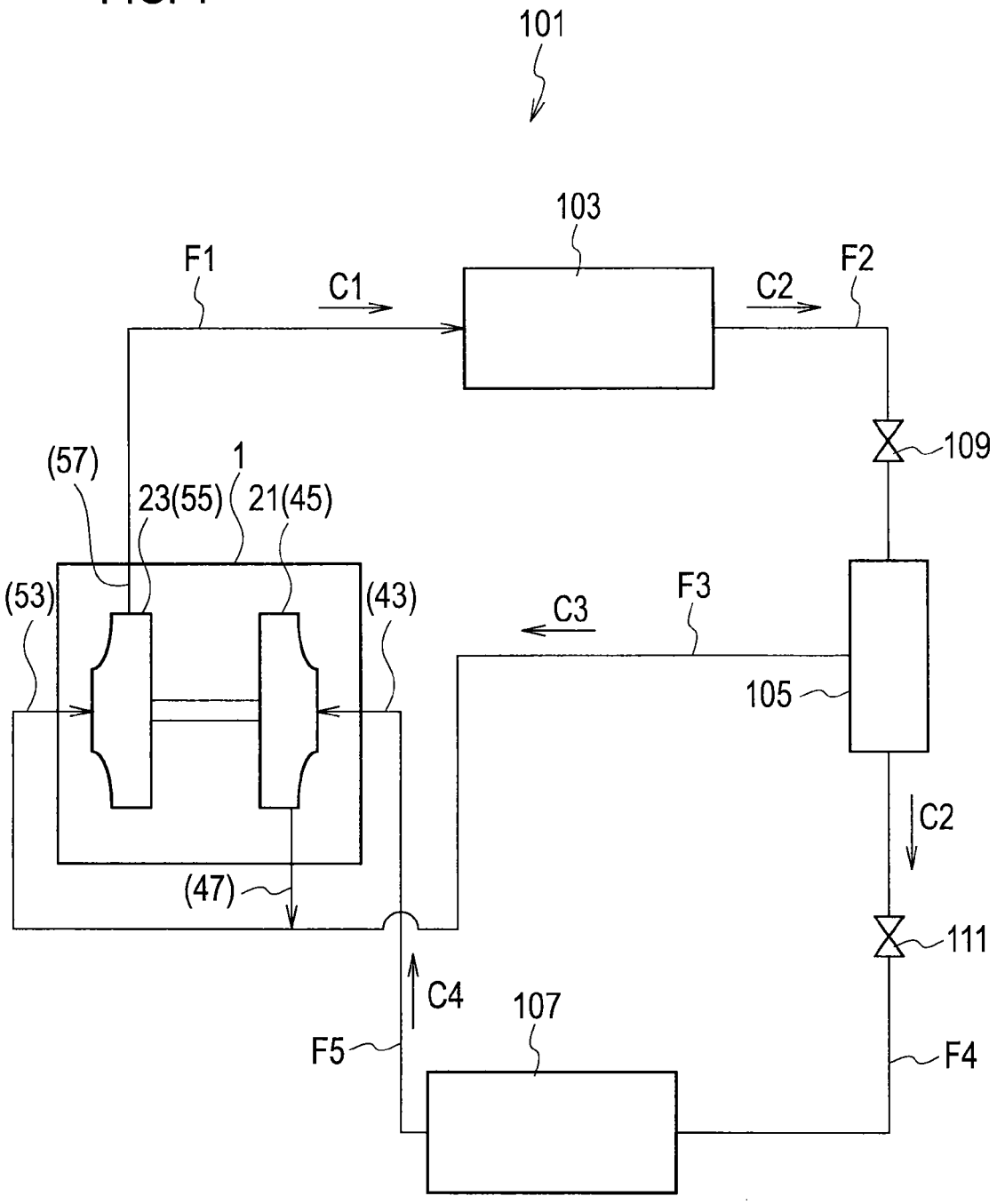
FIG. 1 is a block diagram of a turbo refrigerator including a turbo compressor according to an embodiment.

As shown in FIG. 1, the turbo refrigerator 101 is an apparatus for preparing coolant for air conditioning. The turbo refrigerator 101 includes a condenser 103, an economizer 105, an evaporator 107, and the turbo compressor 1.

The condenser 103 is connected with the turbo compressor 1 via a flow path F1, and connected with the economizer 105 via a flow path F2 on which an expansion valve (pressure reduction valve) 109 is provided. Refrigerant gas C1 compressed by the turbo compressor 1 is supplied to the condenser 103 through the flow path F1, and the condenser 103 condenses the compressed refrigerant gas into refrigerant liquid C2 (some remains as refrigerant gas). The refrigerant liquid C2 condensed by the condenser 103 is decompressed by the expansion valve 109 on the flow path F2, and then supplied to the economizer 105.

The economizer 105 is connected with the turbo compressor 1 via a flow path F3, and connected with the evaporator 107 via a flow path F4 on which an expansion valve (pressure reduction valve) 111 is provided. The economizer 105 temporarily accumulates the refrigerant liquid C2 (part thereof is refrigerant gas) decompressed by the expansion valve (pressure reduction valve) 109 after being condensed by the condenser 103. Gas-phase component (refrigerant gas) C3 of the refrigerant liquid C2 (part thereof is refrigerant gas) accumulated by the economizer 105 is supplied to a second compression stage 23 of the turbo compressor 1 via the flow path F3. On the other hand, liquid-phase component of the refrigerant liquid C2 (part thereof is the refrigerant gas) accumulated by the economizer 105 is decompressed on the flow path F4, and then supplied to the evaporator 107.

The evaporator 107 is connected with a first compression stage 21 of the turbo compressor 1 via a flow path F5. The evaporator 107 evaporates the refrigerant liquid C2 decompressed on the flow path F4 into refrigerant gas C4. The refrigerant gas C4 evaporated by the evaporator 107 is supplied to the first compression stage 21 of the turbo compressor 1 via the flow path F5.

The turbo compressor 1 is connected with the condenser 103 via the flow path F1, and has the first compression stage 21 and the second compression stage 23. The turbo compressor 1 compresses the refrigerant gas C4 supplied via the flow path F5 by its first compression stage 21 and then discharges it to the flow path F3, and concurrently compresses the refrigerant gas C3 supplied via the flow path F3 (containing the refrigerant gas discharged from the first compression stage 21) by its second compression stage 23 and then discharge it to the flow path F1. The refrigerant gas C1 compressed by the turbo compressor 1 is supplied to the condenser 103 via the flow path F1. The coolant for air conditioning is cooled by heat-exchanging with the refrigerant at the evaporator 107.

Hereinafter, the turbo compressor 1 will be explained with reference to FIG. 2 to FIG. 4.

The turbo compressor 1 includes a gear housing 3 in which lubrication oil is accumulate, a gear 5 housed in the gear housing 3, and a demister 9 disposed above the gear 5 in the gear housing 3. The gear 5 supplies the lubrication oil by its rotations. The demister 9 is provided with intakes 7 (see FIG. 3 and FIG. 4) communicated with an outside of the gear housing 3. The demister 9 catches oil mist of the lubrication oil splashed by the rotations of the gear 5 to return it to a lower portion of the gear housing 3.

A gear cover 11 for catching the lubrication oil splashed by the rotations of the gear 5 and dripping it to the lower portion of the gear housing 3 is provided around the gear 5. In addition, a demister cover 15 for dripping the oil mist of the lubrication oil caught by the demister 9 to the lower portion of the gear housing 3 is provided. A narrow gap 13 is formed, near the demister 9, between the demister cover 15 and an inner wall surface of the gear housing 3 (see FIG. 2 and FIG. 3).

Figure 3:
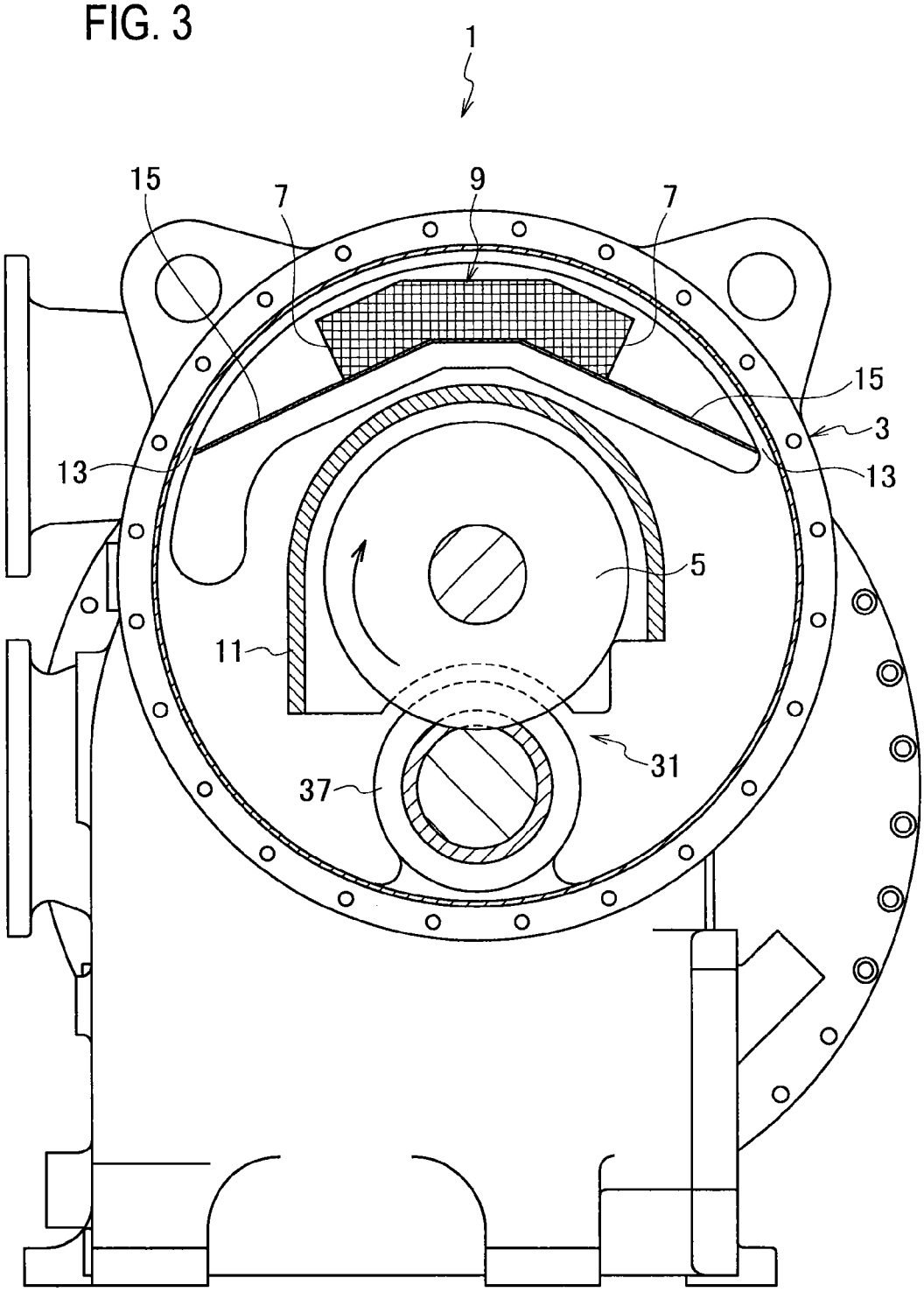
FIG. 3 is a cross-sectional view taken along a line shown in FIG. 2.
Figure 5:
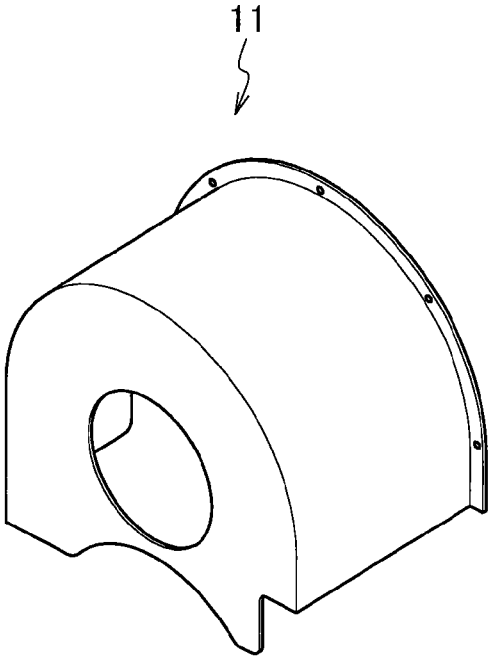
FIG. 5 is a perspective view of a gear cover of the turbo compressor.

In addition, a lower end edge of the gear cover 11 counter to a rotational direction (see an arrow in FIG. 3) of the gear 5 is extended downward further than an opposed-side lower end edge (see FIG. 3 and FIG. 5). Further, a total area of the narrow gap 13 formed between the demister cover 15 and the inner wall surface of the gear housing 3 is made larger than an opening area of the intakes 7 of the demister 9.

Figure 2:
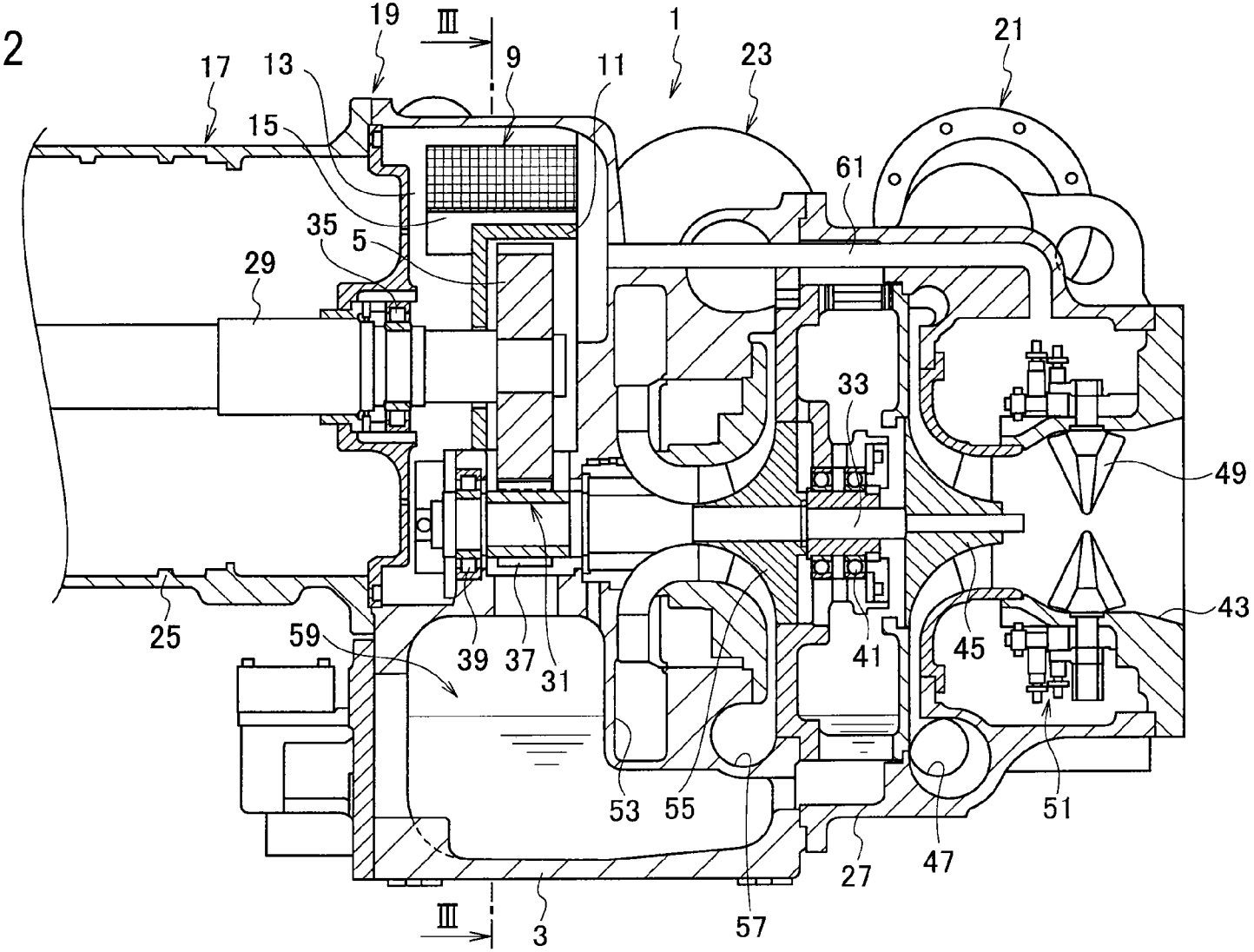
FIG. 2 is a cross-sectional view of the turbo compressor.

As shown in FIG. 2, the turbo compressor 1 is configured of a housing 17, a gear unit 19, the first compression stage 21, the second compression stage 23, and so on.

The housing 17 is composed of a motor housing 25, the above-explained gear housing 3 and a compressor housing 27, and the housings are fixed with each other by bolts or the like. The gear unit 19, the first compression stage 21 and the second compression stage 23 are housed in the housing 17.

The gear unit 19 is configured of a motor (drive source: not shown), an output shaft 29, a gear set 31, and a rotary shaft 33. The output shaft 29 is rotatably supported by the motor housing 25 with a bearing 35 interposed therebetween. Rotations of the output shaft 29 are transmitted to the gear set 31.

The gear set 31 is housed in the gear housing 3, and composed of the above-explained gear 5 as a large-diameter gear and a pinion gear 37 as a small-diameter gear. The gear 5 is fixed with an end of the output shaft 29, and rotates together with the output shaft 29. The pinion gear 37 meshes with the gear 5, and multiplies the rotations of the output shaft 29. The pinion gear 37 is fixed with an end of the rotary shaft 33, and rotates together with the rotary shaft 33.

On end of the rotary shaft 33 along its axial direction is rotatably supported by the gear housing 3 with a bearing 39 interposed therebetween. Another end of the rotary shaft 33 is rotatably supported by the compressor housing 27 with a bearing 41 interposed therebetween. The first compression stage 21 and the second compression stage 23 are driven by rotations of the rotary shaft 33.

The first compression stage 21 is configured of a first inlet port 43, a first impeller 45, and a first scroll chamber 47. The inlet port 43 is provided on the compressor housing 27, and communicated with the flow path F5 (see FIG. 1). Plural inlet guide vanes 49 for adjusting an inlet volume of the refrigerant gas C4 as fluid are disposed in the inlet port 43. The inlet guide vane(s) 49 is rotated by a drive mechanism 51 to change an effective opening area of the inlet port 43, and thereby adjusts the inlet volume of the refrigerant gas C4. The inlet port 43 suctions the refrigerant gas C4 evaporated at the evaporator 107 (see FIG. 1), and then supplies it to the first impeller 45.

The first impeller 45 is fixed with the rotary shaft 33, and rotates together with the rotary shaft 33. The first impeller 45 compresses the refrigerant gas C4 supplied from the inlet port 43 by the rotations of the rotary shaft 33, and then discharges it in its radial directions. The compressed refrigerant gas C4 is supplied to the first scroll chamber 47.

The first scroll chamber 47 is provided in the compressor housing 27, and is communicated with an outer pipe (not shown) provided outside the housing 17. The first scroll chamber 47 supplies the refrigerant gas C4 compressed by the first impeller 45 to the flow path F3 through the outer pipe. Note that the first scroll chamber 47 may be directly communicated with the flow path F3 without the outer pipe interposed therebetween.

The second compression stage 23 is configured of an inlet scroll chamber 53, a second impeller 55, and a second scroll chamber 57. The inlet scroll chamber 53 is provided in the gear housing 3, and communicated with the flow path F3 (see FIG. 1). The inlet scroll chamber 53 suctions the refrigerant gas C3 from the economizer 105 (see FIG. 1) and the refrigerant gas C4 compressed by the first compression stage 21, and then supplies it to the second impeller 55.

The second impeller 55 is fixed with the rotary shaft 33, and rotates together with the rotary shaft 33. The second impeller 55 is oriented so that its back surface faces a back surface of the first impeller 45. The second impeller 55 compresses the refrigerant gas C3 supplied from the inlet scroll chamber 53 by the rotations of the rotary shaft 33, and then discharges it in its radial directions. The compressed refrigerant gas C1 is supplied to the second scroll chamber 57.

The second scroll chamber 57 is provided in the gear housing 3, and is communicated with the flow path F1 (see FIG. 1). The second scroll chamber 57 supplies the refrigerant gas C1 compressed by the second impeller 55 to the condenser 103 through the flow path F1.

As explained above, in the turbo compressor 1, the rotary shaft 33 is rotated by the rotations of the output shaft 29 via the gear set 31. The first compression stage 21 and the second compression stage 23 are driven by the rotations of the rotary shaft 33 to compress refrigerant.

At the first compression stage 21, the refrigerant gas C4 flowing through the flow path F5 is supplied to the first impeller 45 from the inlet port 43. The refrigerant gas C4 supplied to the first impeller 45 is compressed by the first impeller 45, and then supplied to the inlet scroll chamber 53 of the second compression stage 23 through the first scroll chamber 47. Note that the refrigerant gas C3 from the economizer 105 (see FIG. 1) through the flow path F3 is also supplied to the inlet scroll chamber 53 of the second compression stage 23.

The refrigerant gas C3 supplied to the inlet scroll chamber 53 (containing the refrigerant gas from the first compression stage 21) is supplied to the second impeller 55. The refrigerant gas C3 supplied to the second impeller 55 is compressed by the second impeller 55, and then supplied to the condenser 103 (see FIG. 1) through the second scroll chamber 57 and the flow path F1.

An oil tank 59 for accumulating lubrication oil is provided at a lower portion of the gear housing 3. The lubrication oil accumulated in the oil tank 59 is supplied to slidably contact portions such as the above-mentioned bearings 35, 39 and 41 and to gear-meshing portions via an oil cooler (not shown) and an internal pipe(s) (not shown) to lubricate and cool the slidably contact portions and the gear-meshing portions. The slidably contact portions and the gear-meshing portions are communicated with the oil tank 59, and the lubrication oil after lubricating and cooling the slidably contact portions and the gear-meshing portions drips into the oil tank 59 due to gravity to be collected.

In the turbo compressor 1, a pressure equalizing pipe 61 for communicating an inside of the gear housing 3 with a portion near the inlet port 43 is provided in order to supply refrigerant gas generated in the oil tank 59 upon activation of the turbo refrigerator 101 to the portion near the inlet port 43. Here, pressure inside the gear housing 3 in which the gear set 31 and so on are housed becomes relatively high, but pressure of the portion near the inlet port 43 in the compressor housing 27 is lower than the pressure inside the gear housing 3. Therefore, airflow is generated in the pressure equalizing pipe 61 from the gear housing 3 that is a high-pressure side to the portion near the inlet port 43 in the compressor housing 27 that is a low-pressure side due to the pressure difference.

In addition, the lubrication oil is splashed by the rotations of the gear 5 in the gear set 31, and thereby oil mist is generated in the gear housing 3. The oil mist is subject to be discharged out from the gear housing 3 by the airflow through the pressure equalizing pipe 61. Therefore, the demister 9 for catching the oil mist of the lubrication oil is provided in the gear housing 3.

Figure 4:
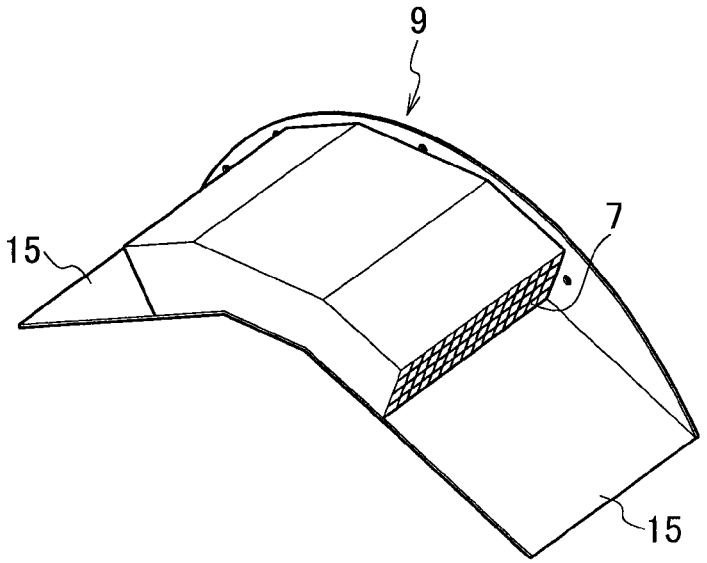
FIG. 4 is a perspective view of a demister and a demister cover of the turbo compressor.

As shown in FIG. 3 and FIG. 4, the demister 9 is disposed above the gear 5 and fixed with the gear housing 3 by bolts or the like to cover an open end of the pressure equalizing pipe 61 opened to the inside of the gear housing 3 (see FIG. 2). In addition, the demister 9 is provided with the two intakes 7 opened to the inside of the gear housing 3. The inside of the demister 9 is configured of a lattice-shaped or mesh-shaped catching member for catching lubrication oil, and catches oil mist contained in refrigerant gas flowing from the intakes 7 to the pressure equalizing pipe 61. The lubrication oil (oil mist) caught by the demister 9 flows downward along sloped surfaces of the demister cover 15 due to its own weight, and then drips from the narrow gap 13 to the lower portion of the gear housing 3 (see FIG. 3) and is collected in the oil tank 59 (see FIG. 2).

As explained above, the lubrication oil splashed by the gear 5 is caught by the demister 9, so that the lubrication oil is prevented from being discharged out from the gear housing 3. However, as explained above, there is a possibility that the demister 9 cannot catch the lubrication oil sufficiently if the lubrication oil passing through the demister 9 is too much. Therefore, the gear cover 11 and the demister cover 15 are provided in the gear housing 3 in the present embodiment.

The gear cover 11 is fixed with the gear housing 3 by bolts or the like so as to surround the gear 5. The gear cover 11 prevents spatters of lubrication oil by the gear 5, and drips the lubrication oil downward to the oil tank 59 provided farthest from the demister 9 at the lower portion of the gear housing 3 to collect it.

In addition, as explained above, the lower end edge of the gear cover 11 counter to a rotational direction of the gear 5 is extended downward further than the opposed-side lower end edge. Therefore, lubrication oil can be received by the gear cover 11 efficiently at a rotation start of the gear 5 when spatters of lubrication oil are most predominant. In addition, the gear cover 11 can be light-weighted because the opposed-side lower end edge is made minimum. The demister cover 15 is disposed above the gear cover 11.

The demister cover 15 is integrated with the demister 9 so as to be inclined downward from the intakes 7 of the demister 9. The inclination of the demister cover 15 is set so that lubrication oil can flow downward against an airflow inhaled into the intakes 7, in consideration of a volume of the airflow inhaled into the intakes 7 and viscosity of lubrication oil.

In addition, as explained above, the narrow gap 13 (see FIG. 2 and FIG. 3) is formed between the demister cover 15 and the inner wall surface of the gear housing 3. The total area of the narrow gap 13 is made larger than the opening area of the intakes 7 of the demister 9. Therefore, it never affects inhaling of gas into the intakes 7 (never reduces an intake volume). The demister cover 15 returns the lubrication oil caught by the demister 9 to the lower portion of the gear housing 3, and protects portions near the intakes 7 from oil mist to restrict lubrication oil that is not caught by the gear cover 11 from reaching the intakes 7.

Since the gear cover 11 that catches lubrication oil splashed by rotations of the gear 5 and then drips it to the lower portion of the gear housing 3 is provided around the gear 5 in the above-explained turbo compressor 1, a distance between the oil tank 59 for accumulating lubrication oil and the demister 9 can be made long and thereby the lubrication oil is restricted from reaching the demister 9.

In addition, the demister cover 15 that drips the lubrication oil (oil mist) caught by the demister 9 to the lower portion of the gear housing 3 is provided and the narrow gap 13 is formed between the demister cover 15 and the inner wall surface of the gear housing 3, so that lubrication oil that is not caught by the gear cover 11 can be restricted from reaching the intakes 7 by the demister cover 15 (and the narrow gap 13).

Therefore, according to the above-explained turbo compressor 1, an amount of lubrication oil that reaches the demister 9 can be reduced by the gear cover 11 and the demister cover 15.

In addition, since the lower end edge of the gear cover 11 counter to a rotational direction of the gear 5 is extended downward further than the opposed-side lower end edge, spatters of the lubrication oil can be restricted effectively on a predominant side of the lubrication oil splashed by the gear 5. Further, since the opposed-side lower end edge of the gear cover 11 is made minimum, the gear cover 11 can be light-weighted.

Furthermore, since the total area of the above-explained narrow gap 13 is made larger than the opening area of the intakes 7 of the demister 9, an amount of lubrication oil that reaches the demister 9 can be reduced by the demister cover 15 (and the narrow gap 13) without degrading inhale performance of the demister 9.

Note that, in the above embodiment, provided are the two intakes 7 that are opened to opposite sides to each other and parallel to a fixture plane of the demister 9 with the housing 17. However, intake(s) that is perpendicular to the fixture plane may be provided. The demister (and its intake(s)) can take any configuration as long as it has a function of catching oil mist.

In addition, the gear cover 11 is formed so as to surround the gear 5. However, the gear cover may have a shape that also surrounds the pinion gear, even if the gear and the pinion gear can mesh with each other. The gear cover may have any shape, even if it can restrict spatters of lubrication oil by the gear (and generation of oil mist involved therewith).

What is claimed is:

1. A turbo compressor comprising:

a housing in which lubrication oil is accumulated;

a gear that is housed in the housing and to which the lubrication oil is supplied;

a demister that is disposed above the gear and on which an intake is provided to catch oil mist of the lubrication oil in the housing;

a gear cover that is provided surrounding the gear to catch lubrication oil splashed by the gear and then drip the caught lubrication oil downward; and a demister cover that is disposed near the demister to drip the lubrication oil caught by the demister downward, wherein a narrow gap is formed between the demister cover and an inner wall surface of the housing.

2. The turbo compressor according to claim 1, wherein a lower end edge of the gear cover counter to a rotational direction of the gear is extended downward further than an opposed-side lower end edge.

3. The turbo compressor according to claim 1, wherein a total area of the narrow gap is made larger than an opening area of the intake of the demister.

4. The turbo compressor according to claim 1, wherein the demister includes at least one intake.

5. The turbo compressor according to claim 4, wherein an area of the narrow gap is larger than an opening area of the at least one intake.

* * * * *